US005112049A

United States Patent [19]

Borg

[11] Patent Number: 5,112,049

[45] Date of Patent: May 12, 1992

[54] PINBALL MACHINE HAVING A PLAY FIELD WHICH IS CHANGED DURING PLAY

[75] Inventor: John D. Borg, Glen Ellyn, Ill.

[73] Assignee: Premier Technology, Bensenville, Ill.

[21] Appl. No.: 392,049

[22] Filed: Aug. 10, 1989

[51] Int. Cl.[5] ..... A63F 7/02

[52] U.S. Cl. ..... 273/127 D; 273/119 A; 273/118 R

[58] Field of Search ..... 273/118 R, 118 A, 118 D, 273/119 R, 119 A, 121 R, 121 A, 122 A, 123 A, 124 A, 125 A, 127 D, 109, 110

[56] References Cited

U.S. PATENT DOCUMENTS

| | | | |
|---|---|---|---|
| 3,578,802 | 5/1971 | Murphy et al. | 273/121 A |
| 4,221,384 | 9/1980 | Krynski | 273/118 D |
| 4,239,219 | 12/1980 | Haefliger | 273/127 R |
| 4,244,575 | 1/1981 | Hori | 273/127 D |
| 4,354,681 | 10/1982 | Garbaric | 273/127 R |
| 4,426,081 | 1/1984 | Fainzilberg | 273/127 D |
| 4,429,876 | 2/1984 | Halliburton et al. | 273/121 A |
| 4,460,175 | 7/1984 | Krynski | 273/121 A |
| 4,508,343 | 4/1985 | Peters et al. | 273/119 A |
| 4.620,706 | 11/1986 | Ijidakinro | 273/127 R |
| 4,773,646 | 9/1988 | Joos, Jr. et al. | 273/121 A |
| 4,892,309 | 1/1990 | Kim et al. | 273/127 R |

FOREIGN PATENT DOCUMENTS

| | | | |
|---|---|---|---|
| 47401 | 3/1982 | European Pat. Off. . | |
| 92648 | 9/1896 | Fed. Rep. of Germany . | |
| 2902749 | 8/1979 | Fed. Rep. of Germany | 273/119 A |
| 3340558 | 5/1985 | Fed. Rep. of Germany | 273/118 A |
| 447361 | 12/1912 | France | 273/121 R |
| 1147448 | 11/1957 | France . | |
| 446436 | 4/1936 | United Kingdom | 273/121 R |

*Primary Examiner*—Edward M. Coven
*Assistant Examiner*—Jessica Harrison
*Attorney, Agent, or Firm*—Arnold, White & Durkee

[57] ABSTRACT

A section of the play field is changed during play by replacing components mounted thereon with different components. In other words, the section of the play field is replaced with a new section. Preferably this is done by rotating the section of the play field to expose different components that were previously stored below the play field surface. In a preferred embodiment the section of the play field is coupled by a slip clutch to a continuously running motor, and a solenoid operated catch mechanism stops rotation of the section of the play field when it is approximately parallel to the rest of the play field surface. To change the components included in the play field, the solenoid is energized to release the catch and thereby permit rotation of the section of the play field by approximately 180 degrees.

21 Claims, 4 Drawing Sheets

PINBALL MACHINE HAVING A PLAY FIELD WHICH IS CHANGED DURING PLAY

BACKGROUND OF THE INVENTION

1. Field of the Invention

The present invention relates to a pinball machine of the kind in which a player projects a ball over a play field.

2. Description of the Background Art

The continued popularity of pinball games is due largely to the thought and ingenuity of the designers in incorporating new features to make the games more interesting and exciting in play. In many cases this is done by placing the pinball machine into an unusual state when the player achieves a certain score or can direct the ball to certain targets. The unusual state of the machine, for example, is indicated by flashing lights, bells or sirens. In some cases the unusual state of the machine permits the player to have multiple balls in play at the same time, or gates are opened to permit the balls to access reserved areas of the play field. But the amount of space for the reserved areas of the play field has been limited due to the limited area of the play field surface.

SUMMARY OF THE INVENTION

Briefly, in accordance with the invention, a section of the play field is changed during play by replacing components mounted thereon with different components. In other words, the section of the play field is replaced with a new section. Preferably this is done by rotating the section of the play field to expose different components that were previously stored below the play field surface.

In a preferred embodiment the section of the play field is coupled by a slip clutch to a continuously running motor, and a solenoid operated catch mechanism catches rotation of the section of the play field when it is approximately parallel to the rest of the play field surface. The solenoid is energized to release the catch and thereby permit rotation of the section of the play field by approximately 180 degrees to change the components included in the play field.

BRIEF DESCRIPTION OF THE DRAWINGS

Other features and advantages of the invention will become apparent upon reading the attached detailed description and upon reference to the drawings in which.

Figure 1:
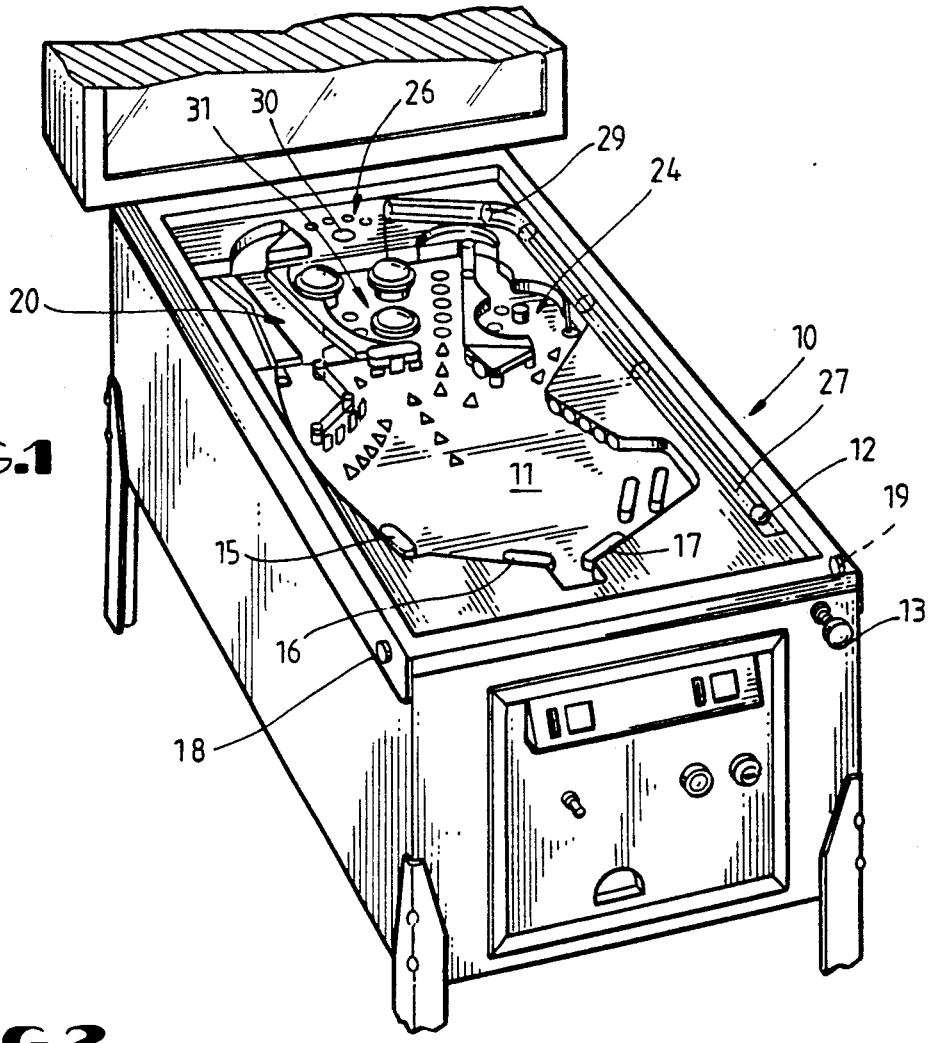
FIG. 1 is a perspective view of a pinball machine having a play field which incorporates a changeable play field section in accordance with the present invention.

While the invention is susceptible to various modifications and alternative forms, specific embodiments thereof have been shown by way of example in the drawings and will herein be described in detail. It should be understood, however, that it is not intended to be limited to the particular embodiments shown, but on the contrary, the intention is to cover all modifications, equivalents and alternatives falling within the spirit and scope of the appended claims.

DETAILED DESCRIPTION OF THE PREFERRED EMBODIMENTS

Turning now to the drawings, there is shown in FIG. 1 a pinball machine 10 having a play field 11 in which a ball 12 is put in play by means of a spring plunger 13. The ball is kept in play by means of manually operated flippers 15, 16, 17 operated by respective buttons 18, 19 positioned along the sides of the machine.

Figure 2:
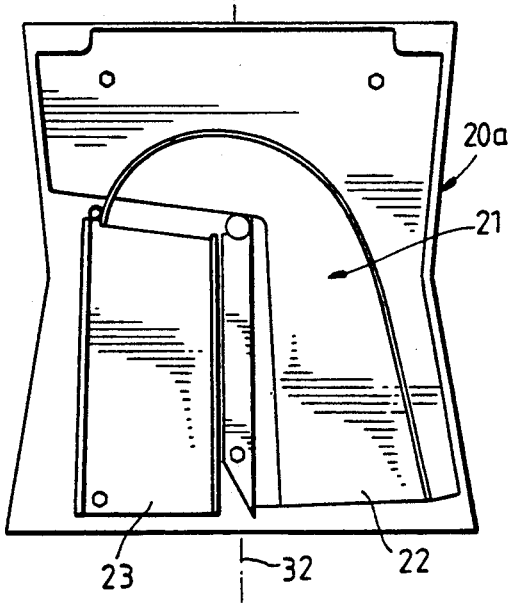
FIG. 2 is a plan view of a first configuration of the changeable play field section of FIG. 1.
Figure 3:
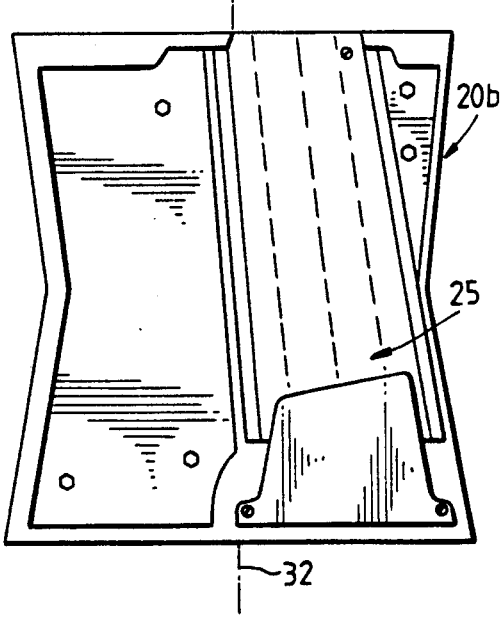
FIG. 3 is a plan view of a second configuration of the changeable play field section of FIG. 1.

In accordance with the present invention, the play field 11 includes a changeable play field section generally designated 20 which can be changed between the configuration **20*a* shown in FIG. 2 to the configuration 20*b* shown in FIG. 3. The configuration 20*a* of FIG. 2 has a U-shaped turn-around generally designated 21 which may receive a ball at its entrance 22 and feed the ball around to its exit 23. This permits the player to feed a ball from the flippers 16, 17 around to the upper side flipper 15 which the player may use to access a restricted area 24** of the play field.

The configuration **20*b* as shown in FIG. 3 has a ramp 25 that allows the player to operate the flippers 16, 17 to shoot the ball 12 back to an upper level 26 of the play field. The only other way to reach the upper level 26 is off the plunger slot 27 via a chute 29. It is desireable for the player to reach the upper play field level 26 to rapidly advance his or her score by landing the ball in a target 30 or upon reaching a restricted area 31** of the play field.

In accordance with a further aspect of the present invention, the section 20 of the play field is changed from the configuration **20*a* to the configuration 20*b* by rotating the section 20 approximately 180° about an axis 32** approximately parallel to the plane of the play field.

Figure 4:
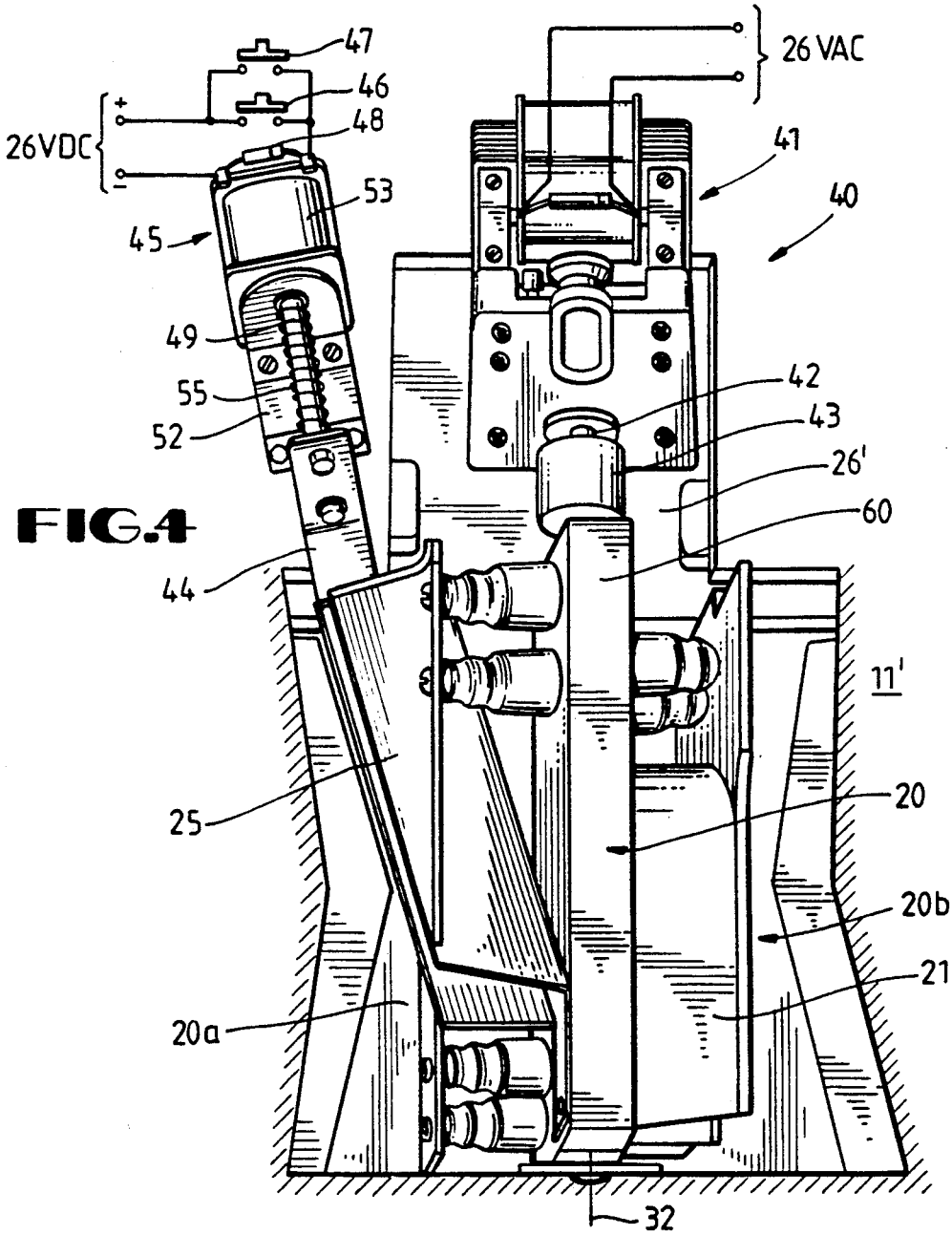
FIG. 4 is a bottom view looking up underneath the play field of the pinball game of FIG. 1 when the changeable play field section of FIG. 1 is being changed between the configurations of FIG. 2 and FIG. 3.

Turning now to FIG. 4, there is shown a perspective view of a mechanism generally designated 40 for rotating the play field section 20. The mechanism 40 is mounted on the underside 11' of the play field surface. In particular, the section 20 is mounted in an opening in the play field 11 and is rotated about its axis 32 by an electric motor 41. Preferably the electric motor provides clockwise rotation of 6 RPM and runs off 26 VAC, 60 Hz. A suitable motor is a model 658 sold by Multi-Products, 2052 Grove Avenue, Racine, Wisconsin 53405. The motor 41 is mounted on the underside 26' of the upper play field level 26. This permits the axis of the output shaft 42 of the motor 41 to lie in the plane of the play field along the axis 32.

In accordance with another feature of the present invention, the motor 41 runs continuously, and the motor is coupled to the play field section 20 by a slip clutch 43. The slip clutch 43, for example, is a model C-81 slip coupling sold by Machine Components Corp., 70 Newtown Road, Planeview, New York, 11803. To selectively rotate the play field 20 in 180 degree increments, free rotation of the play field section 20 is blocked by a catch bracket 44 which contacts the underside of the play field section 20 after the play field section has been rotated to become aligned approximately parallel with the rest of the play field surface.

To change the configuration of the play field section, a solenoid generally designated 45 is energized by closure of a switch 46 or 47 to retract the catch and thereby permit rotation of the play field section 20. A diode 48 prevents arcing at the switch contacts when the circuit is broken.

Figure 5:
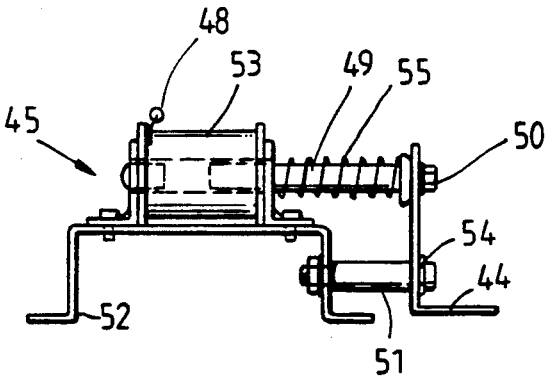
FIG. 5 is a side view of a solenoid catch mechanism which is cycled to cause the changeable play field section of FIG. 1 to switch between the configurations of FIG. 2 and FIG. 3.

A side view of the solenoid 45 is shown in FIG. 5. The catch lever 44 is fastened to a plunger 49 by a screw 50. To guide the catch bracket 44, the bracket is retained on a shoulder pin 51 secured to a mounting bracket 52 for the solenoid coil 53. The catch bracket 44 is retained on the plunger 51 by a snap ring 54 and is normally biased against the snap ring by a plunger return spring 55.

Figure 6:
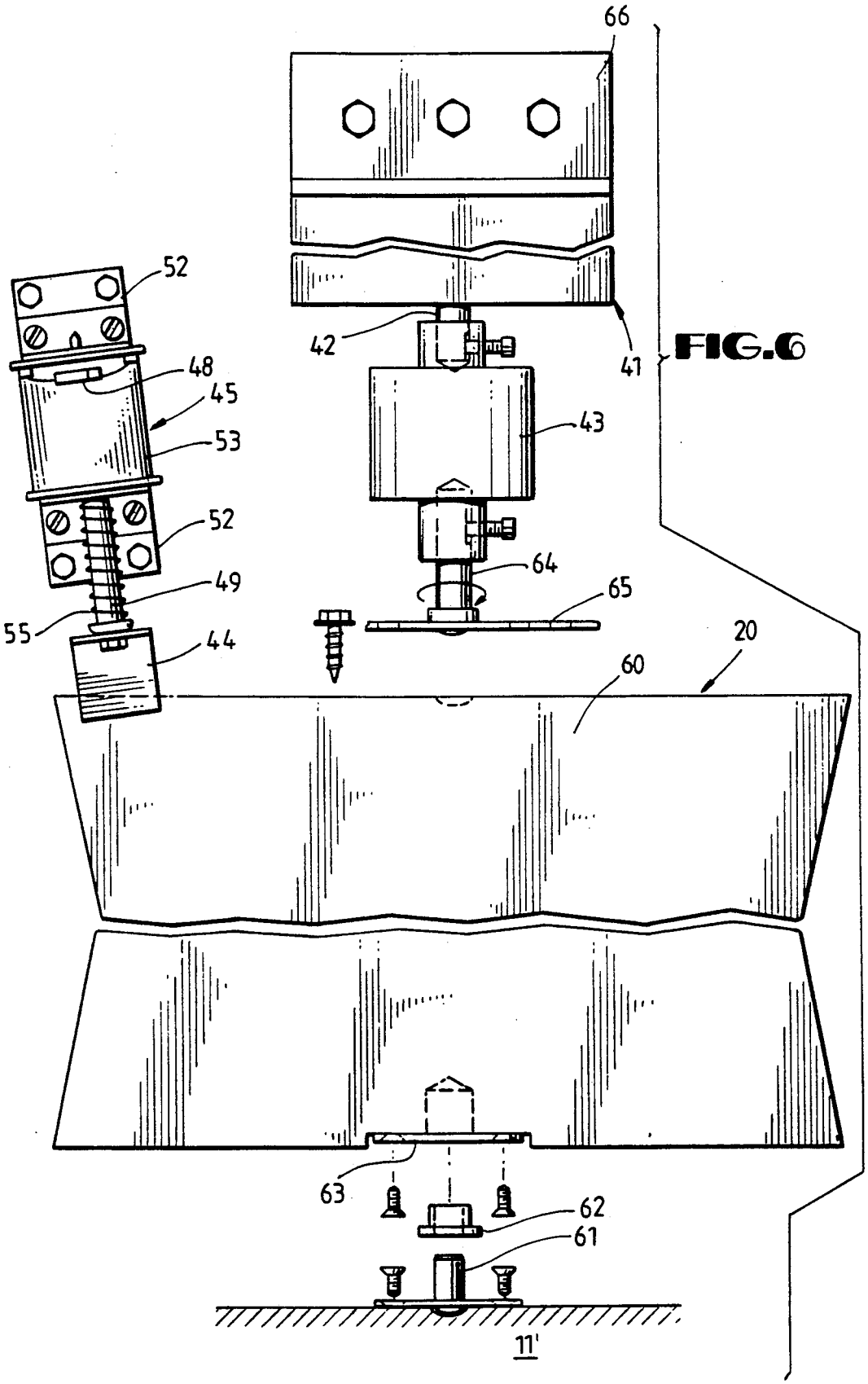
FIG. 6 is a bottom schematic view corresponding to FIG. 4 which more clearly illustrates the mechanical connections between the various components.

Turning now to FIG. 6, there is shown a more detailed view of the mechanical connections to the play field section 20. The play field section 20 has a planar base 60 which is made, for example, out of plywood. The base 60 is pivotally mounted to the play field 11' by a shaft 61 secured to the play field 11' and a bronze bearing 62 retained in a plate 63 fastened to the base 60.

The front end of the base 60 is mounted to the slip clutch 43 by a shoulder pin 64 fastened to a plate 65 that is in turn fastened to the base 60. Therefore the front end of the base 60 is mounted through the slip clutch 43 to the shaft 42 of the motor 41. The motor 41 is mounted by a bracket 66 screwed to the underside 26' of the upper play field level.

Figure 7:
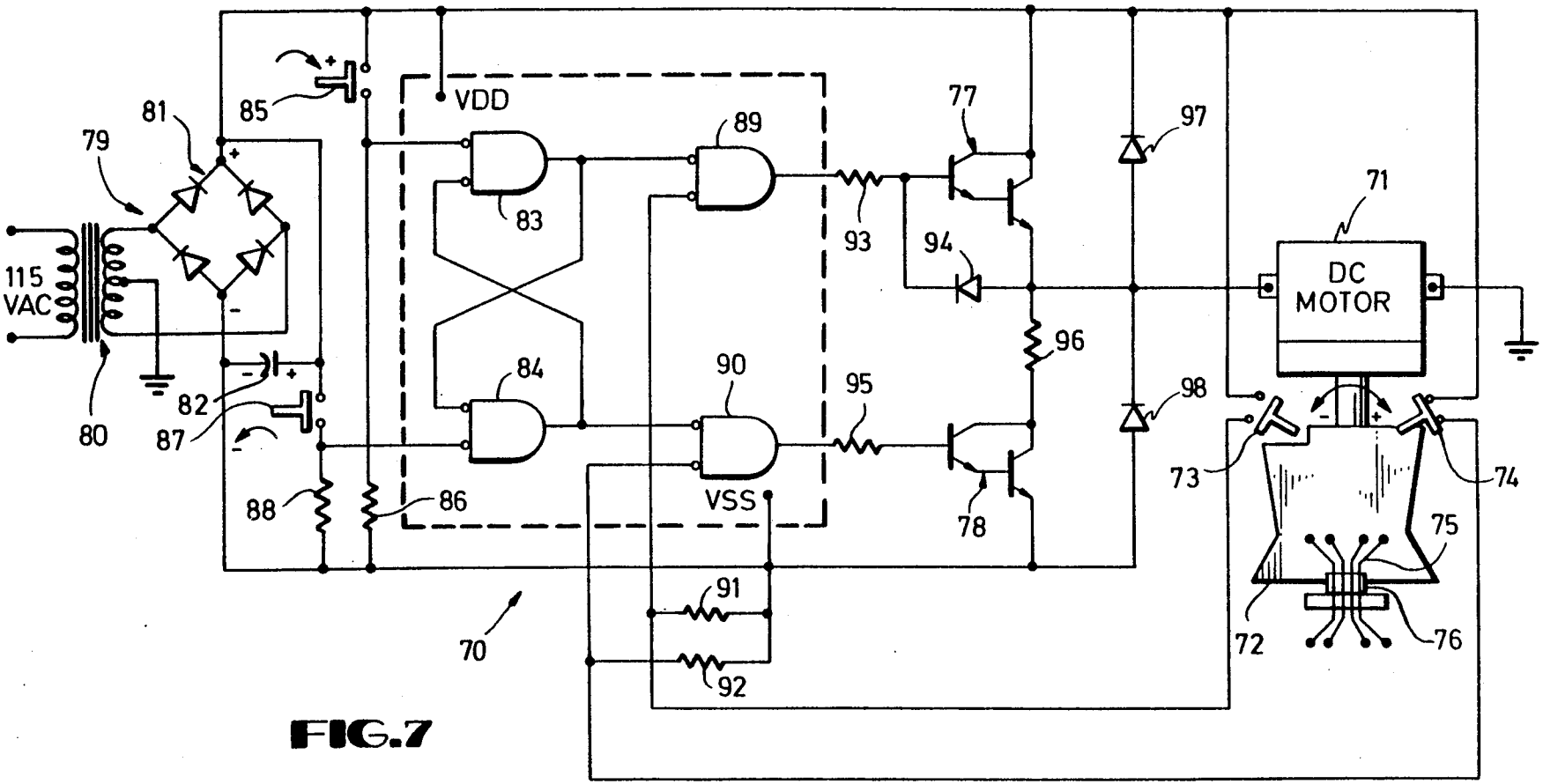
FIG. 7 is an alternative embodiment having electronic control logic substituted for the solenoid catch mechanism of FIG. 5.

As described above, the preferred embodiment of the present invention uses a continuously running AC motor 41, a slip clutch 43 and a solenoid mechanism 45 to selectively change the play field section 20 between the first configuration **20*a* and the second configuration 20*b*. It should be readily apparent, however, that alternative means could be used to selectively rotate the play field section 20. One possible alternative is shown in FIG. 7. In this case control logic generally designated 70 applies either a positive or negative voltage to a DC motor 71 to pivot a play field section 72 over a 180 degree range to change between a first configuration and a second configuration. The ends of the 180 degree range are defined by push button switches 73 and 74** acting as limit stops.

Because the pivoting of the play field section 72 in FIG. 7 occurs over a limited range, electrical connections to lamps or switches (not shown) on the play field section are easily made by a flexible multi-conductor cable 75 passing through the center of a lower pivot shaft 76. A disadvantage to the system of FIG. 7, however, is that means such as transistors 77 and 78 are required to switch the polarity of voltage applied to the DC motor 71 to run the motor in both a clockwise and a counter-clockwise direction, and a DC power supply 79 is also required. The power supply 79, for example, includes a center-tapped 12-volt step-down transformer 80, a bridge rectifier 81, and an electrolytic capacitor 82.

Since the DC motor 71 needs to be driven in either a clockwise or counter-clockwise direction for some time in response to some intermittent signal to change the play field, the control logic 70 includes a set-reset flip-flop provided by cross-coupled NOR gates 83 and 84 (such as part No. 4001B). A normally open switch 85 such as a target on the play field in connection with a pull-down resistor 86 generates an intermittent signal to begin driving the DC motor 71 in a clockwise direction. Conversely, a normally-open switch 87 in connection with a pull-down resistor 88 generates a signal to begin driving the DC motor 71 in a counter-clockwise direction. These signals are latched in the cross-coupled gates 83 and 84, and are used to enable the motor 71 until the signals are inhibited by gates 89 and 90 when the play field section 72 has been driven to a respective one of the limit switches 73 or 74, which work in connection with respective pull-down resistors 91 and 92.

The transistors 77 are turned on by gate 89 to apply a positive voltage to the DC motor 71. The transistors 77 work in connection with a current limiting resistor 93 and a diode 94 which limits any negative bias applied to the transistors 77. The transistors 78 are turned on by gate 90 to apply a negative voltage to the DC motor 71. The transistors 78 work in connection with current limiting resistors 95 and 96. The resistor 96 limits current in the event that transistors 77 and also transistors 78 are on at the same time. This should only occur for a brief interval of time when logic signals from gates 83 and 84 are changing state. Diodes 97 and 98 are provided to conduct transient current when the transistors 77 or 78, respectively, are switched off. Typical component values are, for example, 500 microfarads for capacitor 82, 22 K ohms for resistors 86, 88, 91 and 92, 10 K ohms for resistors 93 and 95, and 2.7 ohms for resistor 96.

In view of the above, there has been provided a means for increasing the available space of the play field by providing a section of play field that can be changed from one configuration to another. This is conveniently done by rotating or pivoting the play field section to expose a configuration that was previously hidden below the surface of the play field. The play field can be selectively rotated by a continuously operating motor, a slip clutch, and a catch mechanism released by energizing a solenoid. Alternatively, control logic could selectively drive a DC motor to pivot the play field section in one direction or another. Moreover, it should be readily apparent to persons skilled in the art that control of a DC motor in the desired fashion could also be performed by a microcomputer that is programmed to perform the control logic functions.

I claim:

1. In a pinball game, the combination comprising:

a play field having components mounted thereon;

means operable by a player for projecting a ball over said play field to contact said components; and means for changing a section of said play field to replace the components mounted thereon with different components, wherein said means for changing includes means selectively actuated by an electrical signal for rotating said section of said play field to expose different components preciously stored beneath the play field surface and an electrical circuit providing said electrical signal.

2. The combination as claimed in claim 1, wherein said means for rotating includes an electric motor.

3. The combination as claimed in claim 2, wherein said means for rotating further includes a slip clutch connected between said motor and said play field section.

4. The combination as claimed in claim 1, wherein said means for changing further includes means for catching and selectively releasing the play field section for rotation.

5. The combination as claimed in claim 4, wherein said means for catching and selectively releasing includes a solenoid.

6. The combination as claimed in claim 1, wherein said electrical circuit includes a switch responsive to said ball.

7. The combination as claimed in claim 1, wherein said section of said play field has a first planar surface upon which are mounted a first plurality of discrete ball-deflecting components, and a second planar surface upon which are mounted a second plurality of discrete ball-deflecting components, and wherein said section of said play field is mounted for rotation to remove said first plurality of ball-deflecting components from said play field and replace them with said second plurality of ball deflecting components.

8. In a pinball game, the combination comprising:

a play field having a planar base on which components are mounted; and means operable by a player for projecting a ball over said play field to contact said components;

wherein said play field base has an opening into which a planar section is mounted to said base for rotation by at least approximately 180 degrees about an axis approximately parallel to said planar base, said planar section having components mounted thereon, and wherein said combination further comprises an electric motor coupled between said planar base and said planar section for rotating said planar section by at least approximately 180 degrees about said axis and an actuator coupled to said motor to cause incremental rotation of said planar section from a first angular position to a second angular position to thereby change the components in said play field.

9. The combination as claimed in claim 8, wherein said actuator comprises a catch operable by a solenoid for selectively blocking rotation of said planar section when said planar section is approximately parallel to said planar base.

10. The combination as claimed in claim 9, wherein a slip clutch is connected between said motor and said planar section.

11. The combination as claimed in claim 8, wherein said play field further includes an upper portion above the plane of said planar base, and wherein said motor is mounted below the upper portion of said play field and has an output shaft aligned with said axis.

12. The combination as claimed in claim 11, wherein a ramp is mounted to one side of said planar section, said ramp extending from the planar base to the upper portion of said play field when said planar section is rotated by said motor to place said ramp in the play field.

13. The combination as claimed in claim 12, wherein a U-shaped channel is mounted to the other side of said planar section.

14. The combination as claimed in claim 8, further comprising a switch responsive to said ball for activating said actuator.

15. In a pinball game, the combination comprising:

a play field having a planar base on which components are mounted; and means operable by a player for projecting a ball over said play field to contact said components;

wherein said play field base has an opening into which a planar section is mounted to said base for rotation by at least approximately 180 degrees about an axis approximately parallel to said planar base, said planar section having components mounted thereon, and wherein said combination further comprises an electric motor coupled between said planar base and said planar section for rotating said planar section by at least approximately 180 degrees about said axis to thereby change the components in said play field, a slip clutch connected between said motor and said planar section, and a catch operable by a solenoid for selectively blocking rotation of said planar section when said planar section is approximately parallel to said planar base.

16. The combination as claimed in claim 15, wherein said play field further includes an upper portion above the plane of said planar base, and wherein said motor is mounted below the upper portion of said play field and has an output shaft aligned with said axis.

17. The combination as claimed in claim 16, wherein a ramp is mounted to one side of said planar section, said ramp extending from the planar base to the upper portion of said play field when said planar section is rotated by said motor to place said ramp in the play field.

18. The combination as claimed in claim 17, wherein a U-shaped channel is mounted to the other side of said planar section.

19. In a pinball game, the combination comprising:

a play field having a planar base on which components are mounted; and means operable by a player for projecting a ball over said play field to contact said components;

wherein said play field base has an opening into which a play field section is mounted to said base for rotation about an axis approximately parallel to said planar base, said play field section has a first planar surface upon which are mounted a first plurality of discrete ball-deflecting components, and said play field section has a second planar surface upon which are mounted a second plurality of discrete ball-deflecting components, and wherein said combination further comprises a rotary actuator responsive to electrical signals to incrementally rotate said play field section between a first angular position wherein said first planar surface is approximately parallel to said planar base and a second angular position wherein said second planar surface is approximately parallel to said planar base, and an electrical circuit responsive to movement of said ball and providing said electrical signals to activate said rotary actuator.

20. The combination as claimed in claim 19, wherein said electrical circuit includes at least one target switch activating said rotary actuator.

21. The combination as claimed in claim 19, wherein said electrical circuit includes a first switch activating said rotary actuator to rotate said plate field section from said first angular position to said second angular position, and a second switch activating said rotary actuator to rotate said play field section from said second angular position to said first angular position.

* * * * *